United States Patent [19]

Banes

[11] Patent Number: 4,479,105

[45] Date of Patent: Oct. 23, 1984

[54] PYROTECHNIC CURRENT INTERRUPTER

[75] Inventor: Alexander J. Banes, Palos Park, Ill.

[73] Assignee: G & W Electric Company, Blue Island, Ill.

[21] Appl. No.: 473,236

[22] Filed: Mar. 8, 1983

[51] Int. Cl.[3] ..... H01H 85/00; H01H 37/76

[52] U.S. Cl. ..... 337/4; 337/30; 337/243; 337/401; 200/150 R

[58] Field of Search ..... 337/415, 182, 183, 184, 337/185, 281, 401, 283, 290, 30, 243; 200/150 R, 61.08

[56] References Cited

U.S. PATENT DOCUMENTS

| | | | |
|---|---|---|---|
| 4,176,385 | 11/1979 | Dethlefsen | 361/58 |
| 4,224,491 | 9/1980 | Kroon | 200/150 R |
| 4,342,978 | 8/1982 | Meister | 337/6 |

*Primary Examiner*—Harold Broome

*Attorney, Agent, or Firm*—Fitch, Even, Tabin & Flannery

[57] ABSTRACT

Apparatus is provided for automatically interrupting current in an electrical circuit before the first current peak which occurs after an excess current condition develops. The apparatus includes a main conductor in the current path which passes the current under normal operating conditions, and pyrotechnic charge means associated with the conductor at several spaced locations which segments the conductor when it is ignited. The charge means is ignited by a fuse link which senses the current and provides a rapid thermal response to excess current conditions, generating sufficient heat to ignite the charge means within a short period of time. A current limiting fuse element may be connected in parallel with the conductor for operation at higher voltages, if needed, and the entire apparatus, including the resistive sensing means, may be contained in a single housing.

8 Claims, 2 Drawing Figures

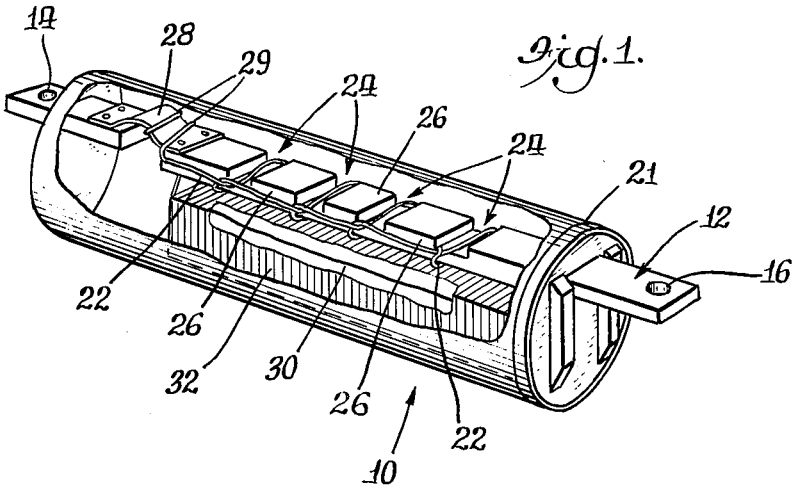
Fig. 1.
Fig. 2.
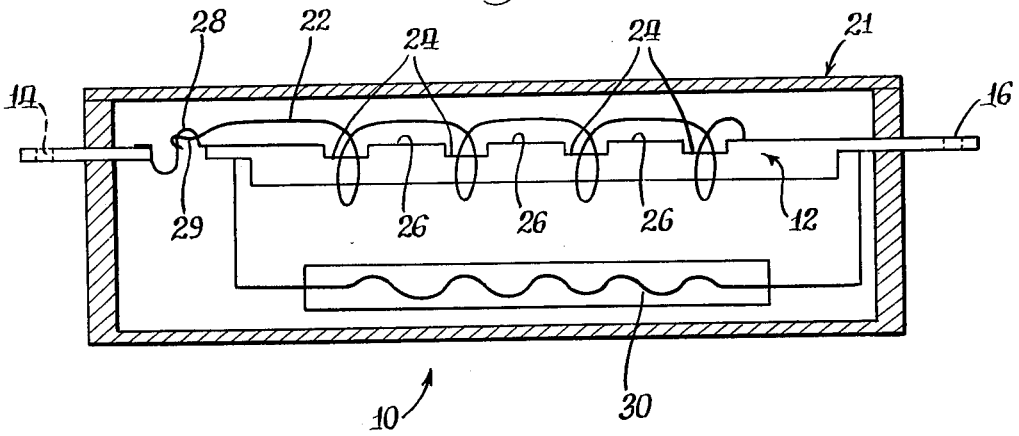

PYROTECHNIC CURRENT INTERRUPTER

This invention relates to apparatus for automatically interrupting current in an electrical circuit under overload conditions, and more particularly to current interrupters for use in relatively high current applications capable of interrupting the current prior to the first current peak when a short circuit or similar fault occurs.

The current in electrical circuits must be interrupted automatically under overload or fault conditions, especially those caused by short circuits and the like, to prevent possible damage to the circuit components. In relatively high power equipment, such as power distribution and transmission apparatus used by utilities and the like, the current must be interrupted very rapidly when an overload condition occurs, preferably within one quarter of a cycle, before the current reaches even one amplitude peak.

Current limiting fuses have been developed which are capable of interrupting current in about 200 microseconds (μs), which is less than one quarter of a cycle. Such fuses generally include a fusible element which is placed in sand or the like. The fusible element includes one or more notches filled with solder. An overload current melts the element at the notches, creating arcs. The sand absorbs enough energy from the arcs to extinguish them, and the current is interrupted. Such fuses are useful in relatively low current applications, but the continuous current carrying capability of such fuses is limited to about 200 amperes. The current carrying capability of the fuses is limited because materials which carry a high continuous current without overheating generally do not overheat and interrupt the circuit quickly enough under short circuit conditions to prevent the current from reaching the first current peak.

More sophisticated current interrupters have been developed which are rated at up to about 2000 amperes continuous current, yet interrupt the current within about 200–300 μs when a fault occurs. In such interrupters, a large cross section conductor carries the current under normal operating conditions. When a fault such as a short circuit occurs, an electronic sensing circuit adjacent the main conductor triggers an electrical impulse to ignite a linear pyrotechnic charge which is secured to the conductor at several spaced locations. The charge breaks the conductor into segments, and arcs form across the gaps created by the charge.

In relatively low voltage applications, the sum of the resistances across the gaps thus created is sufficient to limit the current and interrupt it. In high voltage applications, a current limiting fuse such as that previously described may be connected in parallel with the conductor. Under normal operating conditions, most of the current passes through the conductor, which has a much lower resistance than the fuse. If a short circuit occurs, the charge ignites and arcs form across the gaps in the conductor created by the charge. The total resistance across the conductor is sufficient to transfer a substantial amount of current to the current limiting fuse, which draws enough current to extinguish the arcs, stopping current flow through the conductor and the gaps in the conductor. The fuse then melts, interrupting the current in the circuit. An arc does not form in the fuse because of the arc extinguishing features of the device previously described.

While such current interrupters have proven to be effective, the cost of the devices has prohibited their use in many applications. A substantial portion of the cost is attributable to the electronic sensing circuit which ignites the pyrotechnic charge. The sensing circuit may include isolation transformers, a current sensing transformer, and solid-state triggering logic. An external line voltage power source is generally needed for the sensing circuit, as well, which further adds to the cost of the system. Another problem with the electronic sensing means is that it is generally located outside of and apart from the housing for the conductor, and therefore must be disconnected and reconnected when the conductor is replaced. This adds to the complexity of the system and the difficulty of replacement. Thus, there is a need for alternate means for igniting the pyrotechnic charge in current interrupters of the type described which is less expensive than such electronic sensing circuits, yet permits the current interrupter to interrupt the current before the first current peak following the occurrence of a short circuit condition. There is also a need for such sensing means which does not require external power sources or external connections, and may be installed in a single housing with the other components of the current interrupter.

Accordingly, an object of this invention is to provide new and improved apparatus for interrupting current in an electrical circuit.

Another object is to provide new and improved current sensing means for igniting a pyrotechnic charge in a current interrupter to provide current interruption before the first current peak following the occurrence of a short circuit condition.

Still another object is to provide new and improved current sensing means for igniting a pyrotechnic charge in a current interrupter which does not require an external source of power, and may be assembled in a single housing with the other elements of the current interrupter.

In keeping with one aspect of this invention, apparatus is provided for automatically interrupting current in an electrical circuit before the first current peak which occurs after an excess current condition develops. The apparatus includes a main conductor in the current path which passes the current under normal operating conditions, and pyrotechnic charge means associated with the conductor at several spaced locations which segments the conductor when it is ignited. The charge means is ignited by a fuse link which is connected in series with the conductor and heats when current exceeds a predetermined maximum, generating sufficient heat to ignite the charge means within a short period of time. A current limiting fuse element may be connected in parallel with the conductor for operation at higher voltages, if needed, and the entire apparatus, including the fuse element, may be contained in a single housing, if desired.

These and other objects of this invention and the manner of obtaining them will become more apparent, and the invention itself will be best understood by reference to the following description of the invention taken in conjunction with the accompanying drawings in which:

FIG. 1 is a perspective view of a current interrupter made according to this invention;

FIG. 2 is a schematic view of the current interrupter of FIG. 1.

As seen in FIGS. 1 and 2, apparatus 10 is provided for automatically interrupting current in an electrical circuit under excess current conditions. The circuit may be any circuit within a system which carries relatively high continuous current amperes at voltages generally in the range of 480 V to 38 KV.

The apparatus 10 includes a suitably large cross section conductor 12 made of copper or the like which is capable of carrying the rated current of the circuit under normal operating conditions. The conductor 12 preferably has connecting means such as bolt holes 14, 16 at its opposite ends to facilitate installation of the apparatus in an electrical circuit. The apparatus 10 may be assembled in a housing 21 and may be removed from the circuit simply by disconnecting it at the bolt holes and removing it as a unit.

A linear pyrotechnic charge means 22 is placed adjacent to several cutting locations 24 on the conductor 12. The charge means 22 may be a continuous piece of explosive charge material such as PRIMACORD, and is preferably wound along the conductor 12 with portions disposed in pre-formed notches or cutting locations 24. The notches or cutting locations 24 are relatively thin portions of the conductor 12 which are spaced from each other by thicker segments 26.

In accordance with the present invention, the pyrotechnic charge means 22 is ignited by a fuse link 28 which is connected in series with the conductor 12 and which heats at least to the ignition temperature of the charge means 22 when current flow through the link exceeds a predetermined maximum. The fuse link thus functions as a current sensing means which detects fault or overload current and responds by igniting the pyrotechnic charge before the current reaches a peak. The fuse link 28 may melt prior to ignition of the charge means 22, but this is not essential to its function.

A portion 29 of the pyrotechnic charge means 22 is preferably wrapped around the fuse link 28 to achieve efficient heat transfer from the fuse link 28 to the charge means 22. Once this portion 29 of the charge means 22 is heated to its ignition temperature, the charge means ignites over its entire length almost instantaneously to cut through the conductor 12 at the cutting locations 24, thereby forming gaps in the conductor.

In relatively low voltage applications, the formation of gaps in the conductor is sufficient to interrupt current flow. In relatively high voltage applications, however, the gaps are not sufficient to interrupt current flow because the current tends to arc across the gaps.

Accordingly, for high voltage applications, a current-limiting fuse element 30 is connected in parallel with the conductor 12 to temporarily divert a substantial amount of the current from the conductor for a sufficient interval of time to extinguish the arcs. The fuse element 30 has a higher resistance than the conductor under normal operating conditions, but a lower resistance than the conductor 12 after the pyrotechnic charges have formed gaps in the conductor. Accordingly, during normal operating conditions, very little current flows through the fuse, with substantially all of the current flowing through the conductor 12. After the conductor 12 has been segmented by the charge means 22, current is diverted to the fuse element 30. The fuse element quickly melts but within the time it takes for the fuse element to melt, the arcs across the gaps in the conductor 12 are extinguished. When the fuse element melts, the current is then fully interrupted. The fuse 30 may be housed in an enclosure 32 and surrounded by sand which functions as a heat sink, absorbing energy to prevent arcing after the fuse melts.

The many advantages of this invention are now apparent. The fuse link 28 is much less expensive than electronic fault detection apparatus, and makes pyrotechnic current interrupters economical and practical for many applications where they were not previously practical due to their high cost. The present invention provides a current sensing means for which an external source of power is not required, and installation of the interrupter in a circuit may be simplified because the sensing means is located within the interrupter housing.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing substantially from the basic principles of the invention.

What is claimed is:

1. Apparatus for automatically interrupting current in an electrical circuit before the first current peak after an excess current condition develops comprising:

conductor means in said circuit;

pyrotechnic charge means associated with said conductor means for segmenting said conductor means at a plurality of locations when said charge means is ignited; and current sensing means comprising a fuse link connected in series with said conductor to provide a rapid temperature rise in response to said overload condition so as to ignite said charge means.

2. The apparatus of claim 1 wherein said charge means and said sensing means are enclosed in a single housing.

3. The apparatus of claim 1 comprising current limiting fuse means connected in parallel with said conductor means for passing a significant portion of said current when said charge means ignites, limiting said current to extinguish arcs across said segments, heating and breaking to interrupt the flow of current.

4. The apparatus of claim 3 wherein said charge means, said sensing means and said current-limiting fuse means are enclosed in a single housing.

5. Apparatus for automatically interrupting current in an electrical circuit before the first current peak after a fault develops comprising:

conductor means comprising a metal bar having a plurality of notched portions at longitudinally spaced locations along its length, pyrotechnic charge means comprising an explosive cord wrapped around said conductor means and having portions disposed adjacent said notched portions of said conductor means, and a fuse link electrically connected in series with said conductor for transferring heat to said pyrotechnic charge means when current through said fuse link exceeds a predetermined maximum, said pyrotechnic charge means having a portion wrapped around said fuse link to receive heat transfer from the fuse link so that upon occurrence of a fault current said pyrotechnic charge will be ignited and said conductor will be cut into a plurality of disconnected segments.

6. The apparatus of claim 5 wherein said notched portions of said conductor, said pyrotechnic charge means and said fuse link are enclosed within a single housing.

7. The apparatus of claim 5 further comprising current-limiting fuse means electrically connected in parallel with said conductor means for conducting a substantial portion of said current after said charge means ignites for a sufficient period of time to extinguish arcs between said disconnected sections of said conductor.

8. The apparatus of claim 7 wherein said notched portions of said conductor, said pyrotechnic charge means, said fuse link, and said current-limiting fuse means are enclosed within a single housing.

* * * * *